US006142329A

United States Patent [19]

Dotan

[11] Patent Number: 6,142,329

[45] Date of Patent: Nov. 7, 2000

[54] KNOCK-DOWN BIN

[75] Inventor: Moshe Dotan, Hanegev, Israel

[73] Assignee: Dolav Dvir Lahav Plastic Products, Kibbutz Dvir, Israel

[21] Appl. No.: 09/494,042

[22] Filed: Jan. 31, 2000

[51] Int. Cl.[7] ..... B65D 19/18

[52] U.S. Cl. ..... 220/4.33; 220/7

[58] Field of Search ..... 220/4.33, 4.34, 220/7

[56] References Cited

U.S. PATENT DOCUMENTS

| | | | |
|---|---|---|---|
| 1,828,088 | 10/1931 | Robinson . | |
| 3,374,915 | 3/1968 | Verhein et al. . | |
| 3,401,814 | 9/1968 | Chiswell et al. . | |
| 4,128,354 | 12/1978 | Amrogowicz . | |
| 4,662,532 | 5/1987 | Anderson et al. | 220/7 |
| 4,828,132 | 5/1989 | Francis, Jr. et al. | 220/4.33 |
| 5,031,794 | 7/1991 | Wezenberg | 220/7 |
| 5,094,356 | 3/1992 | Miller . | |
| 5,452,817 | 9/1995 | Taravella et al. | 220/4.33 |
| 5,505,323 | 4/1996 | Naoki et al. . | |
| 5,529,199 | 6/1996 | Foster . | |
| 5,638,973 | 6/1997 | Dewey et al. . | |
| 5,642,830 | 7/1997 | Foster | 220/4.33 |

*Primary Examiner*—Joseph M. Moy
*Attorney, Agent, or Firm*—Mark M. Friedman

[57] ABSTRACT

A knock-down bin, formed from molded polymer materials, includes a rectangular base having a length L and a width W, two sides for deploying parallel to the length and a two sides for deploying parallel to the width. The sides meet to define four vertical corner portions. At least one corner portion, and preferably all four, include a hollow vertical corner post integrally formed with one of the sides, the corner post having a vertical hollow channel into which a lateral opening opens. A projection, integrally formed with the other side making up the corner portion, projects through the lateral opening into the vertical channel. A locking element is slidingly deployable within each vertical channel between an unlocked position in which the projection can be inserted and removed from the lateral opening and a locked position in which the locking element engages the projection so as to lock it within the channel, thereby locking together the adjacent first and second sides.

11 Claims, 22 Drawing Sheets

KNOCK-DOWN BIN

FIELD AND BACKGROUND OF THE INVENTION

The present invention relates to containers and, in particular, it concerns a knock-down bin with locking corner assemblies.

It is known to provide containers of many types for transporting produce, manufactured articles, raw materials etc. from one location to another. Such containers are generally configured to be lifted by a fork-lift vehicle and are stackable. These containers, typically referred to as "bins", "box-pallets", "crates" or "totes", will be referred to generically herein as "bins".

In many cases, molded polymer containers are chosen for their light weight, robustness and long usable lifetime. To realize the maximum strength of the polymer materials, polymer bins are often molded in a single piece. As a result, however, they occupy the same volume when transported empty on a return journey as when full on an outbound journey. This extremely inefficient use of space is very costly.

Various disassembling or foldable bins have been developed in an attempt to reduce the transport volume requirements when the bins are empty. All such bins which either disassemble (i.e., come apart into separate elements) or fold (i.e., with all elements remaining interconnected) are referred to generically herein as "knock-down bins". An example of a foldable bin may be found in U.S. Pat. No. 5,094,356 to Miller. An example of a bin which disassembles may be found in U.S. Pat. No. 5,638,973 to Dewey et al.

While offering more efficient use of volume for light-weight applications, knock-down bins generally suffer from a number of disadvantages. Specifically, in many cases, the bins are complicated and inconvenient to assemble and disassemble, requiring a predefined sequence of non-trivial steps. A further problem associated specifically with bins which disassemble into separate elements is the number of elements which must be handled. In addition to the base and sides, a number of additional connecting elements must typically be handled separately. The loss of these elements may render the bin unusable. Furthermore, even the base and the sides once separated become much less convenient to handle.

An additional problem specific to folding bins results from the interconnected nature of the elements which renders the entire container useless if any one element is broken. Furthermore, the height of the walls is usually limited to the dimensions of the base to allow compact folding. This latter limitation can be circumvented by providing multiple hinges in the walls, or by locating a single hinge at a higher position in the wall. Each of these solutions, however, suffers from its own disadvantages, in the first case reducing the strength of the structure and, in the second, wasting space when folded.

Finally reference is made to U.S. Pat. No. 5,505,323 to Naoki et al. This reference relates to a metal container which can be disassembled. To avoid use of nut and bolts, an arrangement of interlocking projections and recesses is used to lock the sides to the base. The projections and recesses are formed so that they can be freely engaged and disengaged by inclining the side relative to the base, but become locked together when the side is brought into an upright position. The upright position is maintained primarily by a clip applied to keep together the upper edges of the sides, in some cases supplemented by a self-locking barb associated with the locking arrangement itself.

There is therefore a need for a knock-down bin formed from molded polymer materials which would provide a strong and durable locking configuration without increasing the number of separate elements which must be handled when the bin is disassembled. It would also be highly advantageous to provide a knock-down bin the sides of which, when collapsed, would fit within another such assembled bin, thereby facilitating convenient and compact return transport of the bins when not in use.

SUMMARY OF THE INVENTION

The present invention is a knock-down bin.

According to the teachings of the present invention there is provided, a knock-down bin comprising: (a) a substantially rectangular base having a first dimension and a second dimension; (b) a first two sides each having a lower edge detachably engagable with the base for deployment parallel to the first dimension; (c) a second two sides each having a lower edge detachably engagable with the base for deployment parallel to the second dimension, such that the first two sides and the second two sides meet to define four vertical corner portions; and (d) at least one locking element deployable to lock together adjacent ones of the first two sides and the second two sides at at least one of the vertical corner portions, wherein the at least one of the corner portions includes a hollow vertical corner post integrally formed with one of the first and second sides, the corner post having a vertical hollow channel and a lateral opening into the channel, the at least one of the corner portions also having a projection integrally formed with another of the first and second sides, the projection being configured to project through the lateral opening into the vertical channel of the corner post, the locking element being configured so as to be slidingly deployable within the vertical channel of the corner post between an unlocked position in which the projection can be inserted and removed from the lateral opening and a locked position in which the locking element engages the projection so as to lock the projection within the channel, thereby locking together the adjacent ones of the first and second sides.

According to a further feature of the present invention, the at least one locking element is implemented as four of the locking elements deployable to lock together adjacent ones of the first two sides and the second two sides at all four of the corner portions.

According to a further feature of the present invention, the first dimension is greater than the second dimension, all of the corner posts being associated with the two second sides such that a maximum length both of the first sides and of the second sides is less than the first dimension by at least twice a thickness of the second sides.

According to an alternative feature of the present invention, the first dimension is equal to the second dimension, each of the first and second sides including one of the corner posts.

According to a further feature of the present invention, the base and at least one of the first and second sides are configured such that the side is engagable with, and disengagable from, the base while held in an inclined position relative to the base, the side becoming locked in engagement with the base when raised to an upright position.

According to a further feature of the present invention, the locking element includes a resilient tab, and wherein the corner post includes a first locating aperture positioned such that, when the locking element is in the unlocked position, the resilient tab engages the first locating aperture so as to retain the locking element in the unlocked position.

According to a further feature of the present invention, the locking element includes a resilient tab, and wherein the corner post includes a second locating aperture positioned such that, when the locking element is in the locked position, the resilient tab engages the second locating aperture so as to retain the locking element in the locked position.

According to a further feature of the present invention, the base, the first and second walls and the locking elements are all formed from polymer materials.

There is also provided according to the teachings of the present invention, a locking configuration for releasably securing together edges of at least part of two adjacent sides at at least one corner portion of a substantially rectangular bin, the locking configuration comprising: (a) a hollow vertical corner post integrally formed with a first of the adjacent sides, the corner post having a vertical hollow channel and a lateral opening into the channel; (b) a projection integrally formed with another of the adjacent sides, the projection being configured to project through the lateral opening into the vertical channel of the corner post; and (c) a locking element configured so as to be slidingly deployable within the vertical channel of the corner post between an unlocked position in which the projection can be inserted and removed from the lateral opening and a locked position in which the locking element engages the projection so as to lock the projection within the channel, thereby locking together the adjacent sides.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
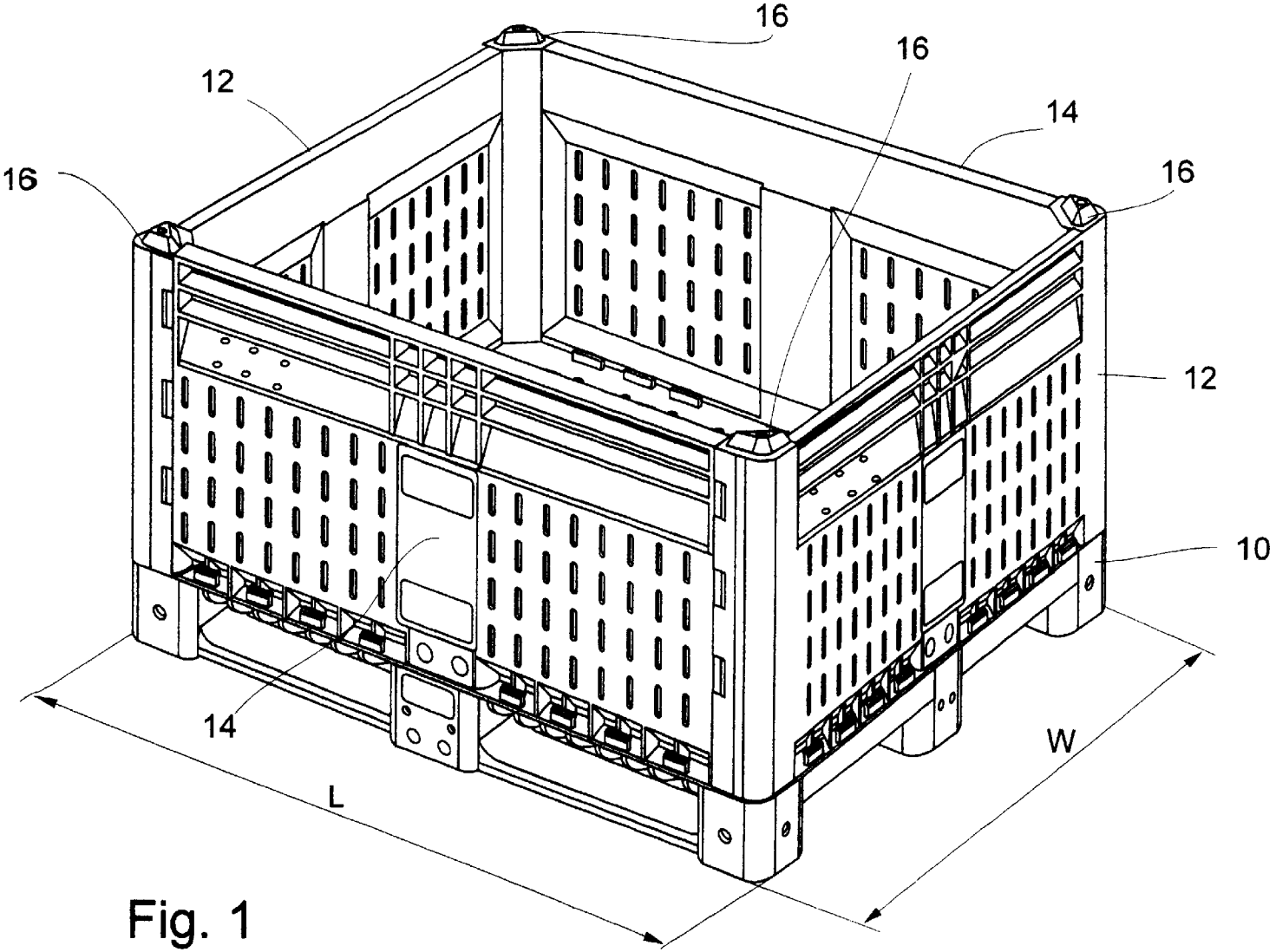
FIG. 1 is a perspective view of a bin, constructed and operative according to the teachings of the present invention.

The present invention is a knock-down bin.

The principles and operation of bins according to the present invention may be better understood with reference to the drawings and the accompanying description.

Referring now to the drawings, FIGS. 1–11 show a knock-down bin, constructed and operative according to the teachings of the present invention, preferably formed from polymer materials. Generally speaking, the knock-down bin includes a substantially rectangular base 10 having a length L and a width W, a first two sides 14 associated with base 10 for deploying parallel to the length and a second two sides 12 associated with base 10 for deploying parallel to the width. Sides 12 and 14 meet to define four vertical corner portions. At least one of these corner portions, and preferably all four, are provided with a locking element 16 deployable to lock together adjacent sides. More specifically, the corner portion includes a hollow vertical corner post 26 integrally formed with one of the sides, corner post 26 having a vertical hollow channel 27 into which opens a lateral opening 24. A projection 22, integrally formed with the other side making up the corner portion, is configured to project through lateral opening 24 into vertical channel 27. Locking element 16 is slidingly deployable within vertical channel 27 between an unlocked position (FIGS. 9A and 9B) in which projection 22 can be inserted and removed from lateral opening 24 and a locked position (FIG. 9C) in which locking element 16 engages projection 22 so as to lock it within channel 27, thereby locking together the adjacent first and second sides 12 and 14.

It will be readily apparent that the locking arrangement of the present invention provides a convenient and effective solution to various shortcomings of the prior art. Specifically, by employing a locking element which may be housed within vertical channel 27 even when in its unlocked position, the number of separate elements to be transported in the collapsed state is minimized. Furthermore, since locking element 16, when in its unlocked position, does not obstruct lateral opening 24, sides 12 and 14 can be conveniently positioned in their upright positions without complicated maneuvering and coordination. Additionally, the locked configuration provides a strong and secure interconnection suitable for relatively heavy duty applications. In a preferred case of a large bin where at least three T-shaped projections 22 are locked within slots 28 of locking element 16 at each corner, degree of rigidity approaching that of a solid molded bin is achieved. These and other advantages of the present invention will become clearer from the following description.

Before addressing the features of the invention in more detail, it should be noted that base 10 is described as "substantially rectangular" to the extent that the resulting bin assumes an overall rectangular form. It should be noted however that the external outline of the edges of the base need not closely resemble a rectangle. Variations from a regular rectangular shape are frequently caused by the form of reinforcing ribs and other features specific to various intended applications.

Turning now to the features of the present invention in more detail, the preferred implementations of the present invention illustrated herein show primarily bins which may be disassembled into separate elements. Accordingly, sides 12 and 14 preferably feature a lower edge configured for detachable engagement with base 10. Most preferably, the form of engagement between sides 12 and 14 and base 10 is configured such that the sides are engagable with, and disengagable from, base 10 while being held in an inclined position relative to the base, but become locked in engagement with base 10 when raised to an upright position. One preferred example of such an engagement configuration will now be described with particular reference to FIGS. 2–4 and 7A–7E.

Figure 2:
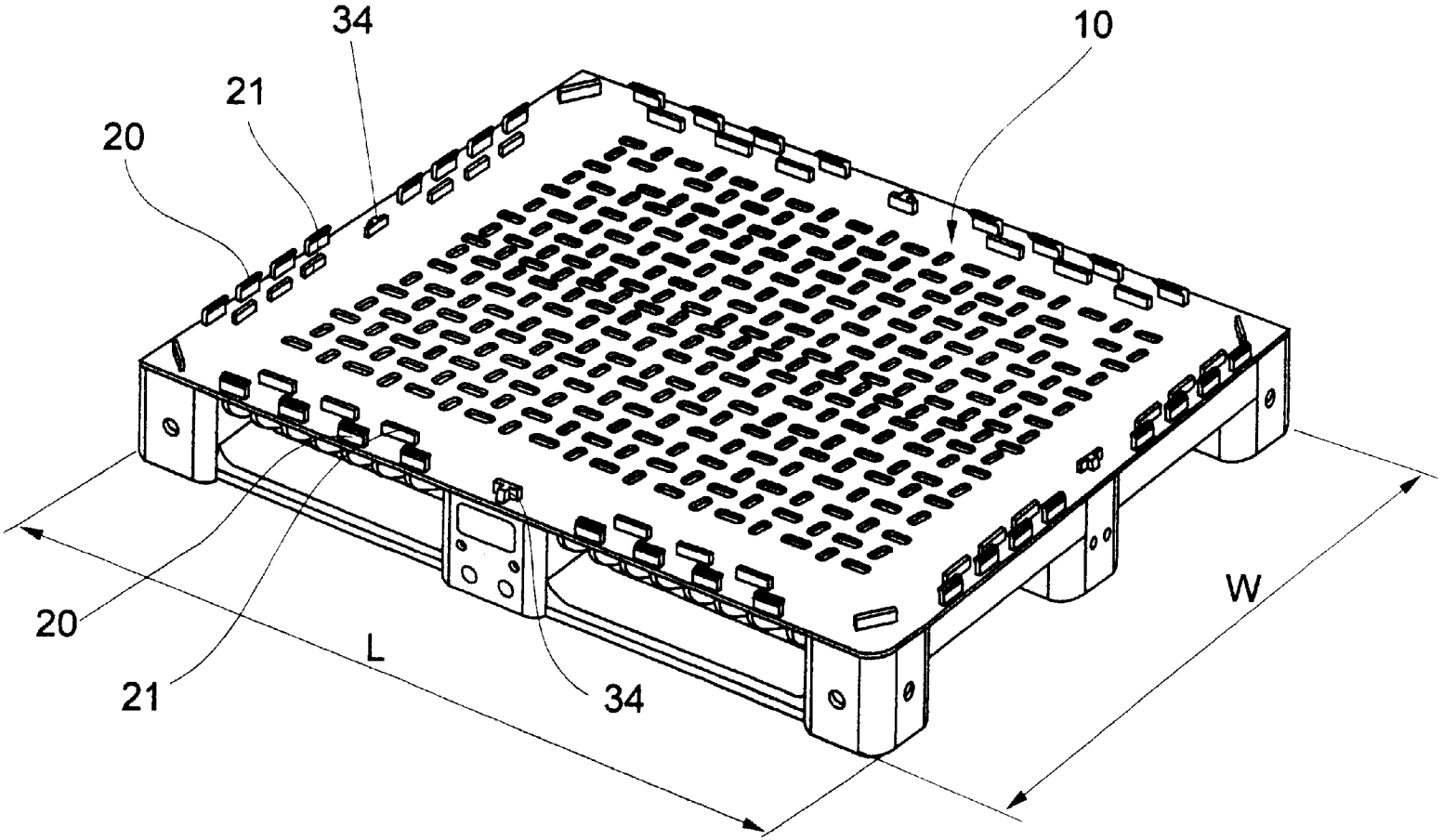
FIG. 2 is a perspective view of a base from the bin of FIG. 1.
Figure 3:
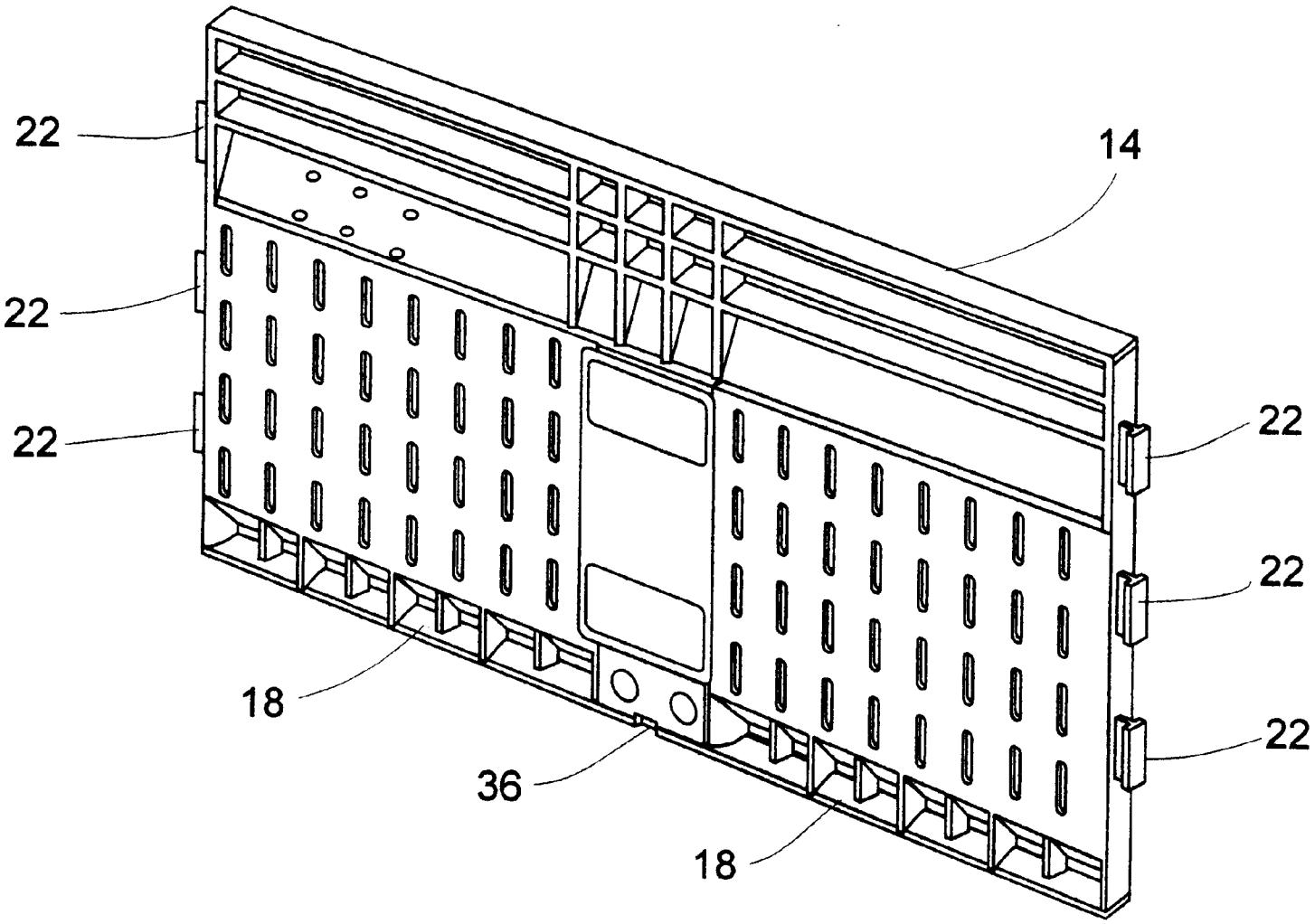
FIG. 3 is an outer perspective view of a first side from the bin of FIG. 1.
Figure 4:
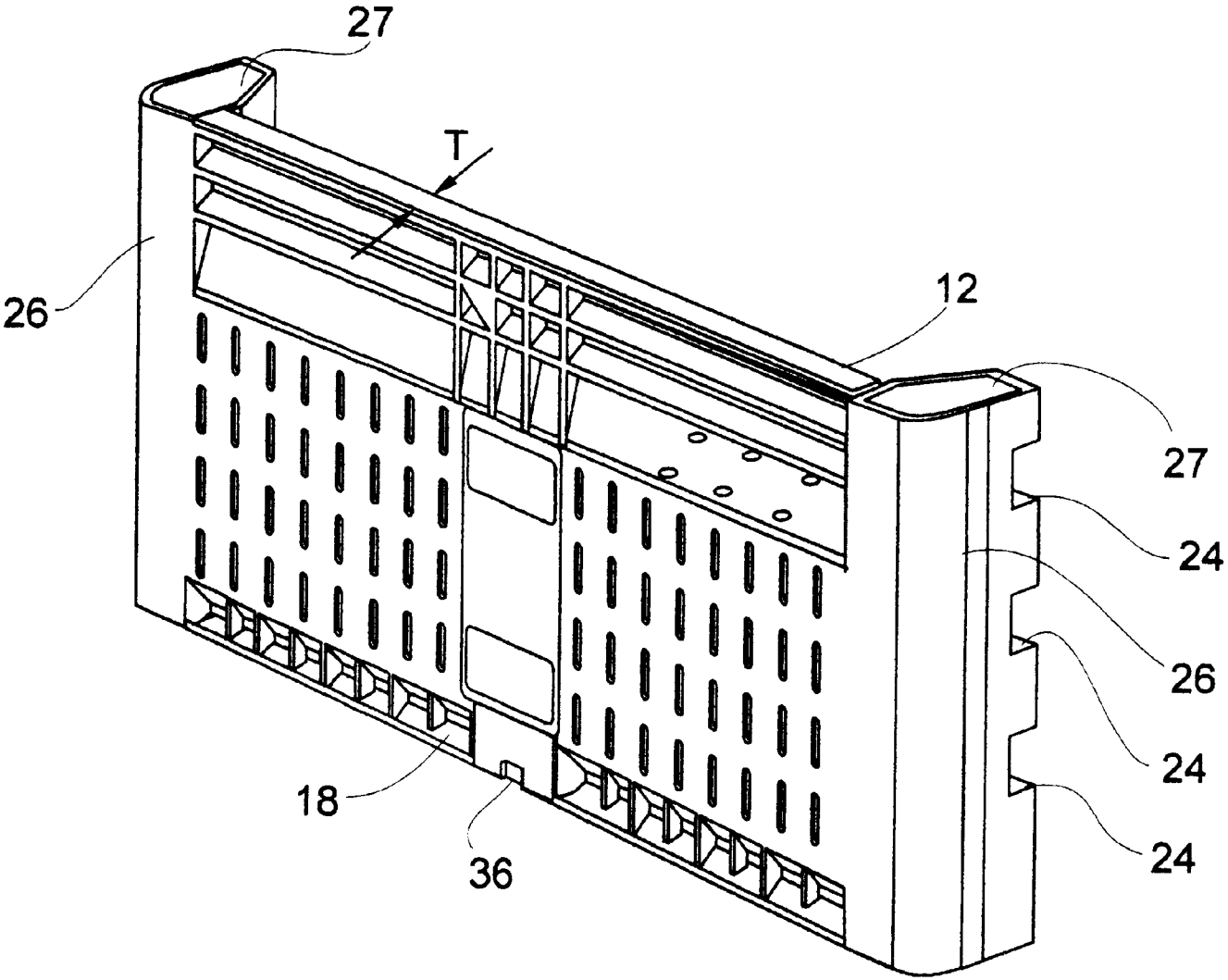
FIG. 4 is an outer perspective view of a second side from the bin of FIG. 1.
Figure 5:
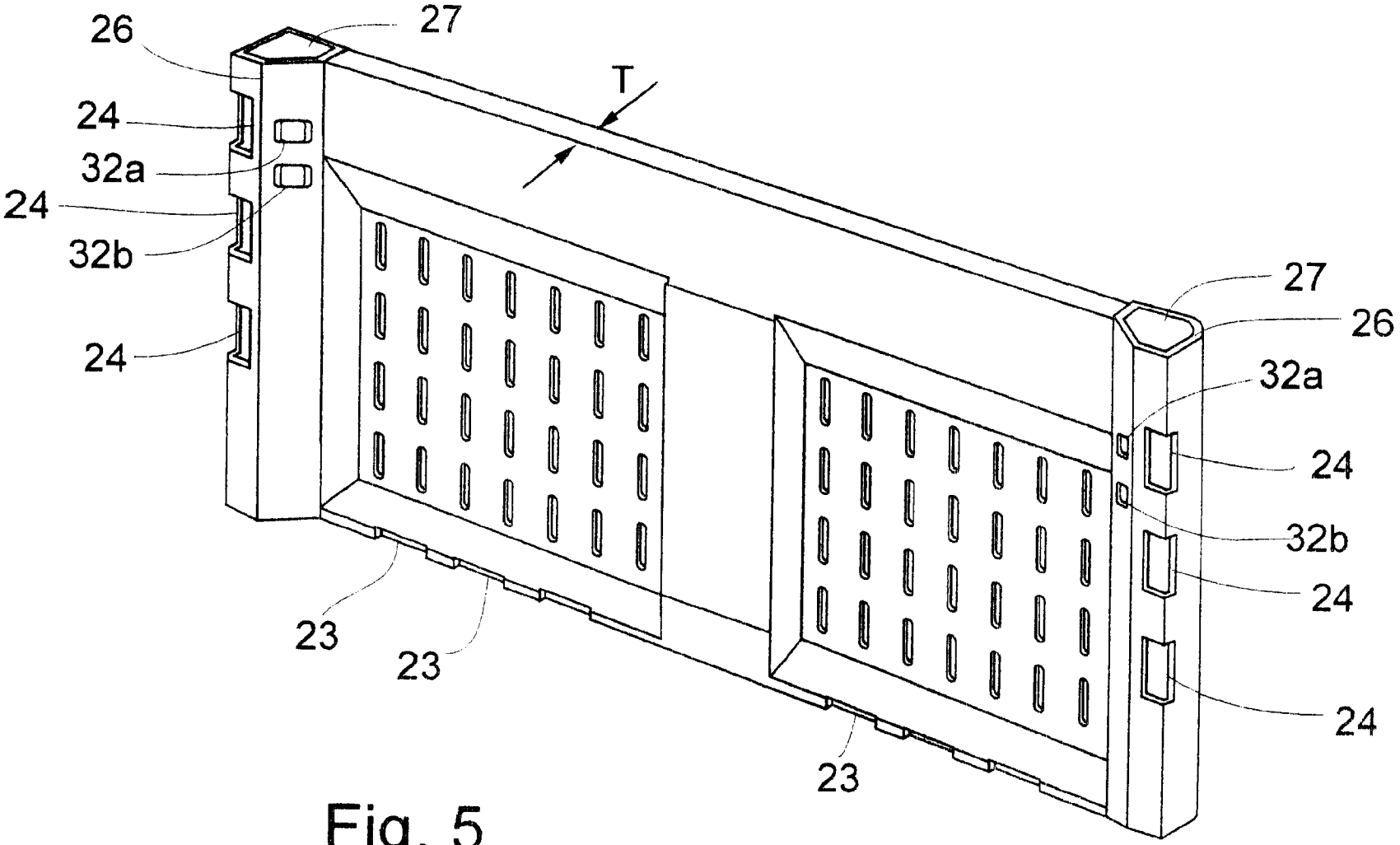
FIG. 5 is an inner perspective view of the second side of FIG. 4.

As seen in FIG. 2, base 10 here features a row of hook brackets 20 spaced along each side. Inwardly spaced on base 10 from brackets 20 are a row of abutment ridges 21. As seen in FIGS. 3 and 4, the outside lower edge of sides 12 and 14 features a row of recesses located to correspond to brackets 20 and configured to provide upward-facing engagement surfaces 18.

Figure 7A:
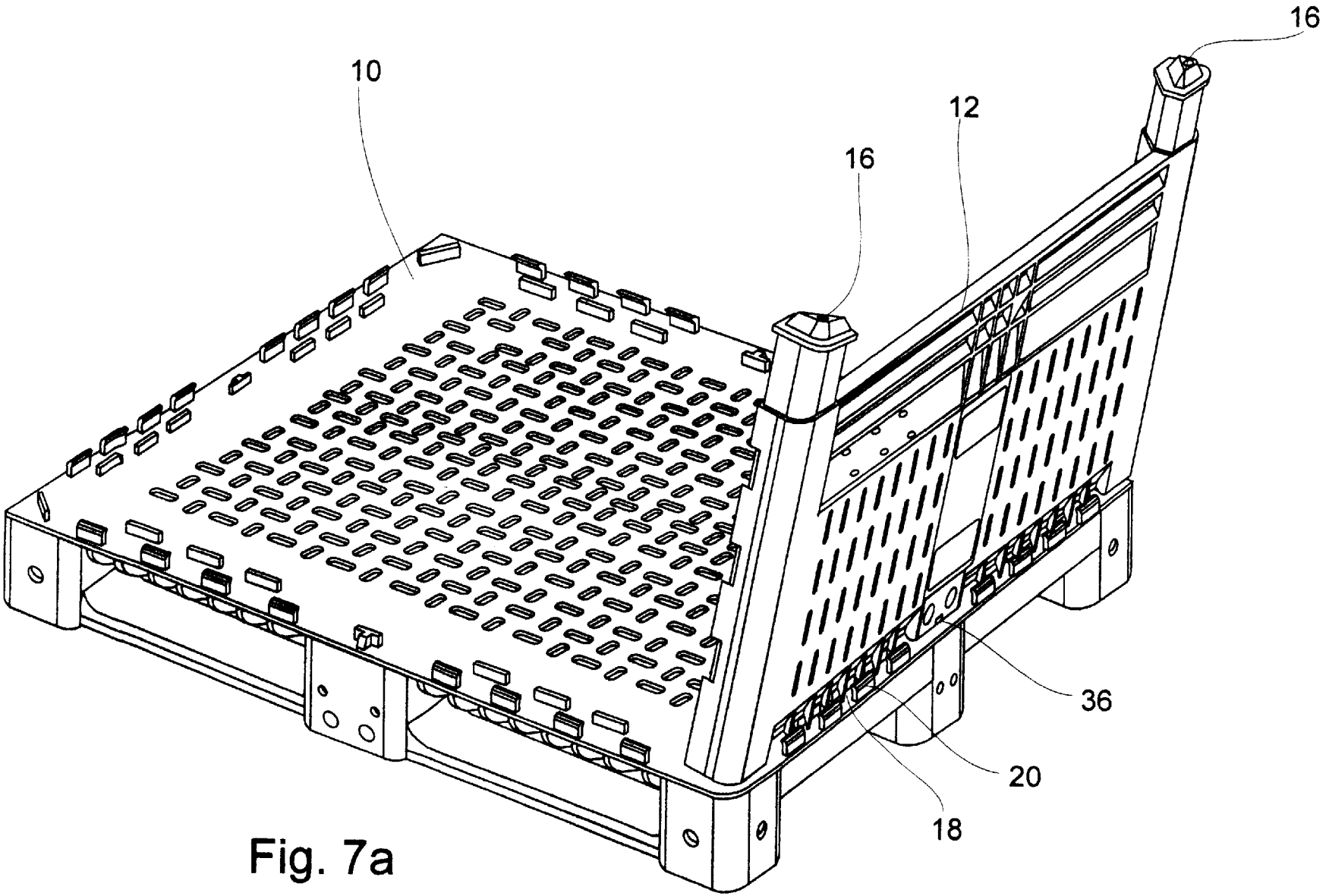
FIG. 7A is a perspective view showing one of the second sides during attachment to the base.
Figure 7B:
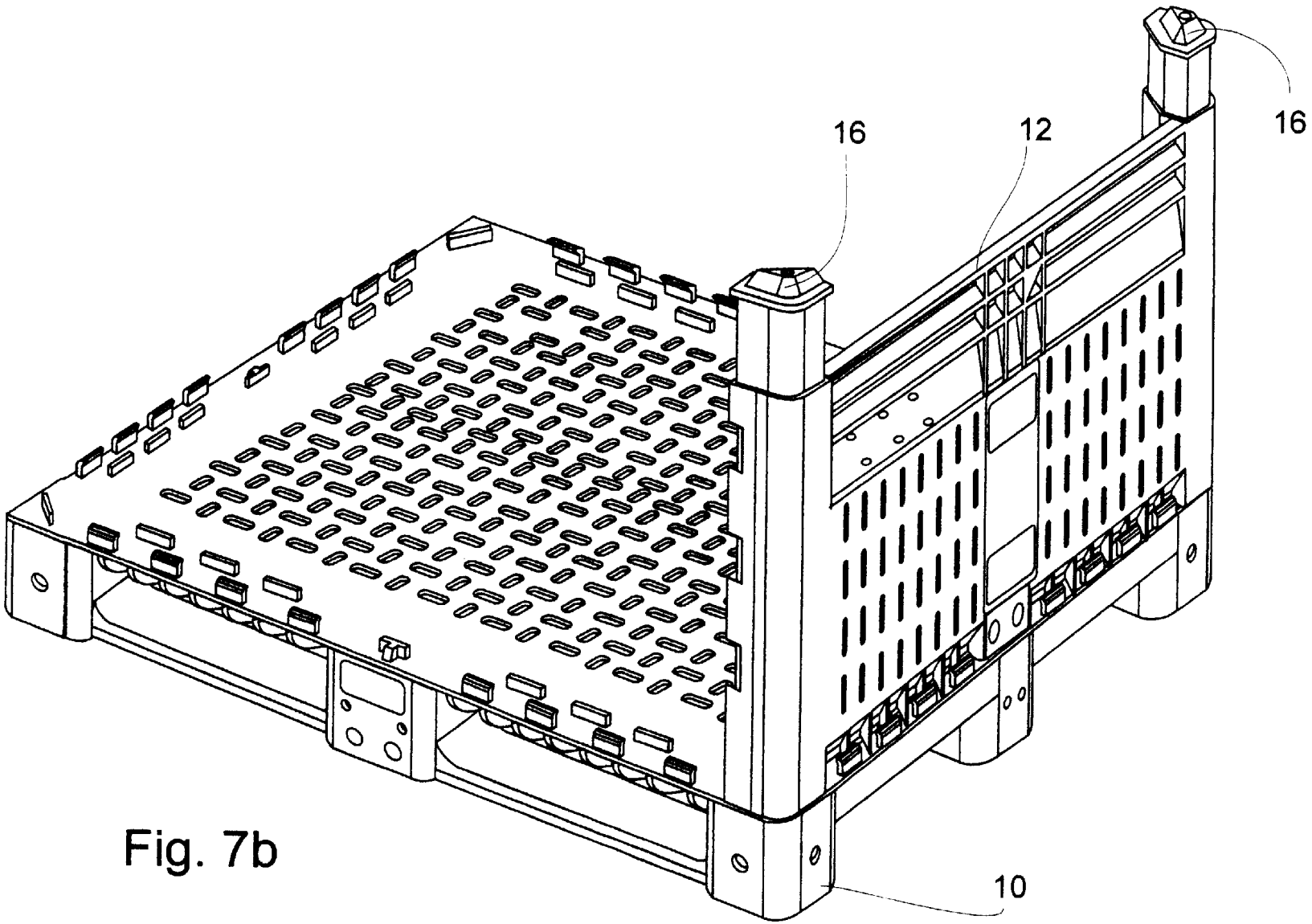
FIG. 7B is a perspective view similar to FIG. 7A after attachment of the second sides to the base.
Figure 7C:
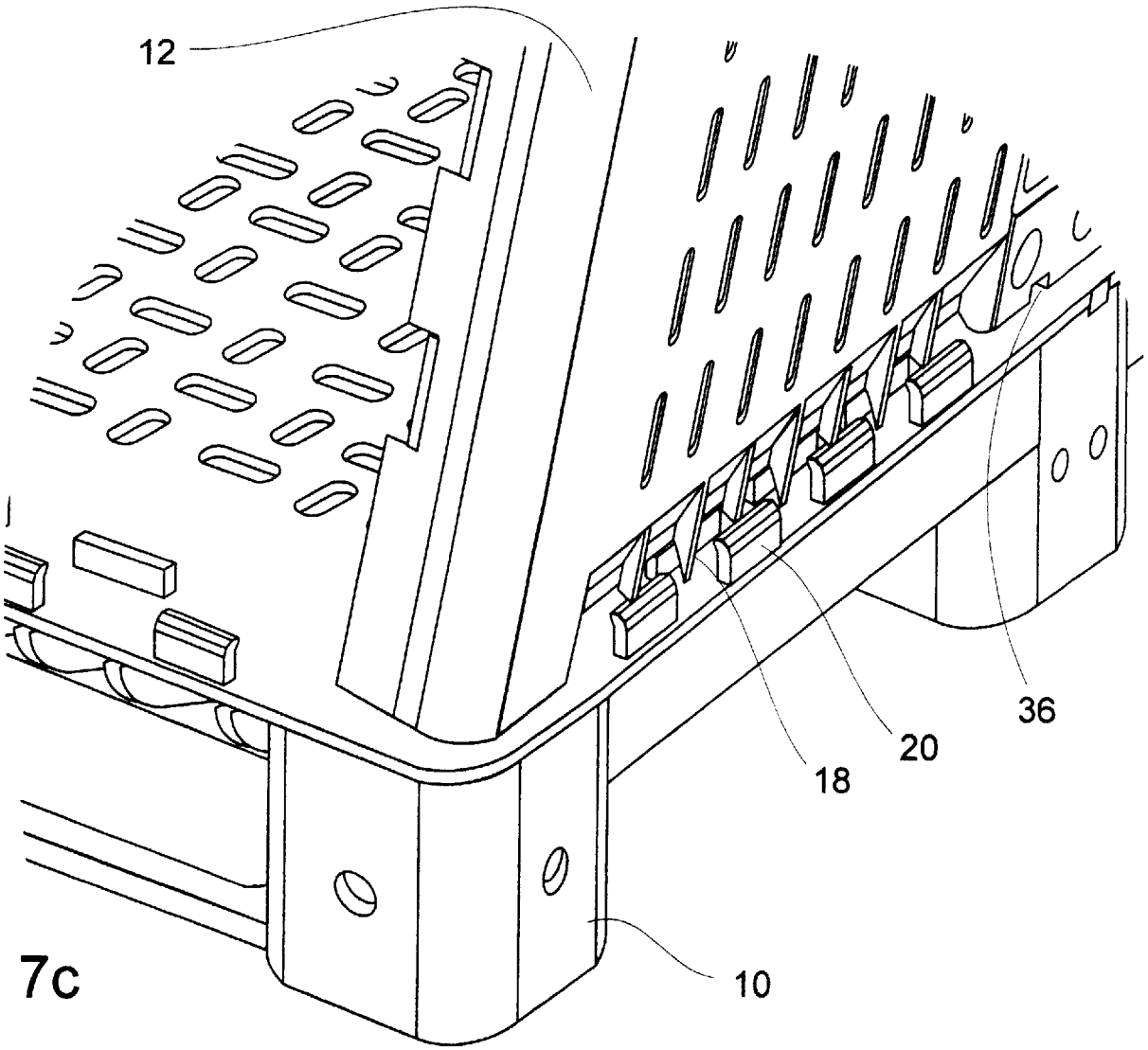
FIG. 7C is an enlargement of a portion of FIG. 7A.
Figure 7D:
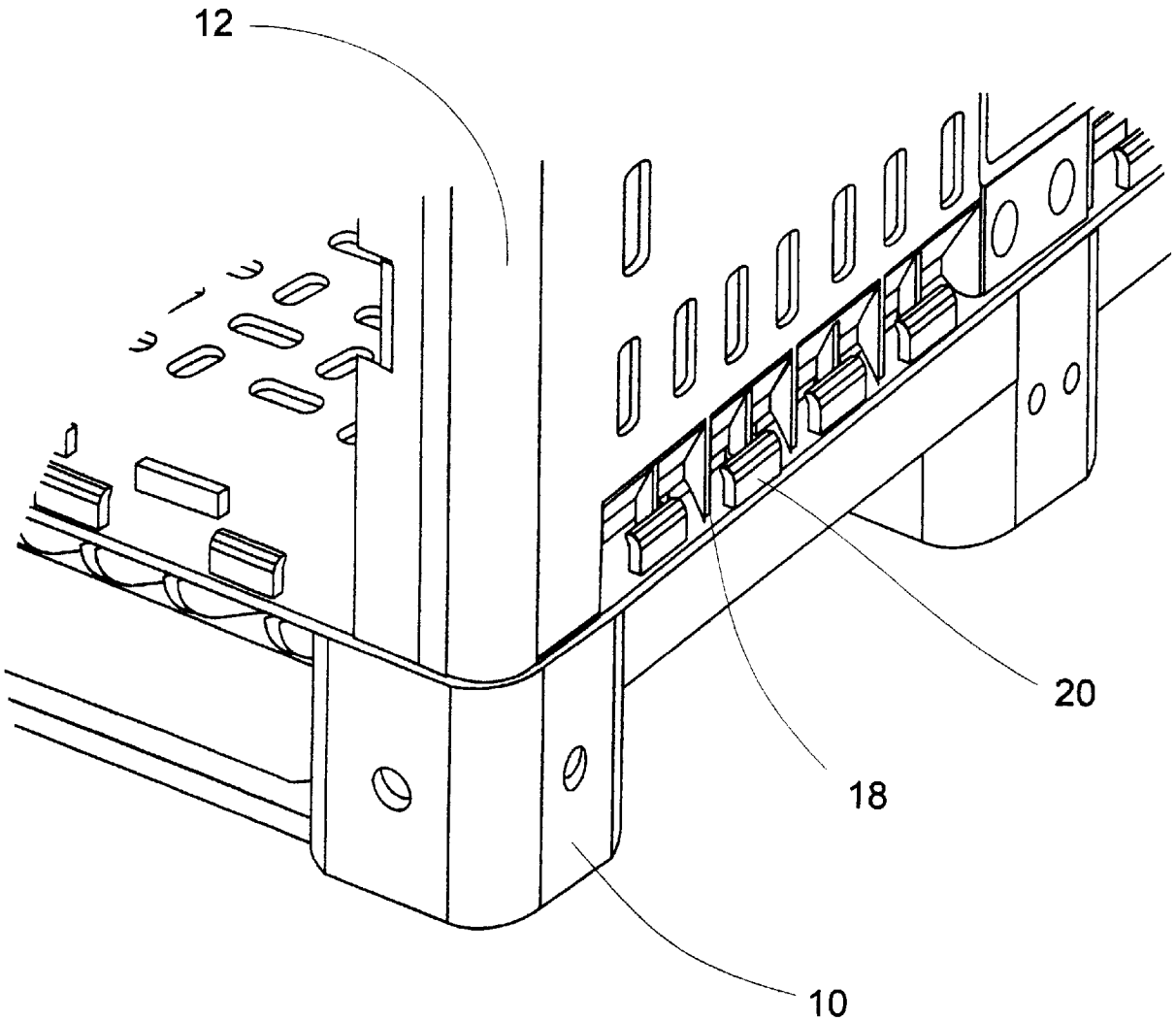
FIG. 7D is an enlargement of a portion of FIG. 7B.
Figure 7E:
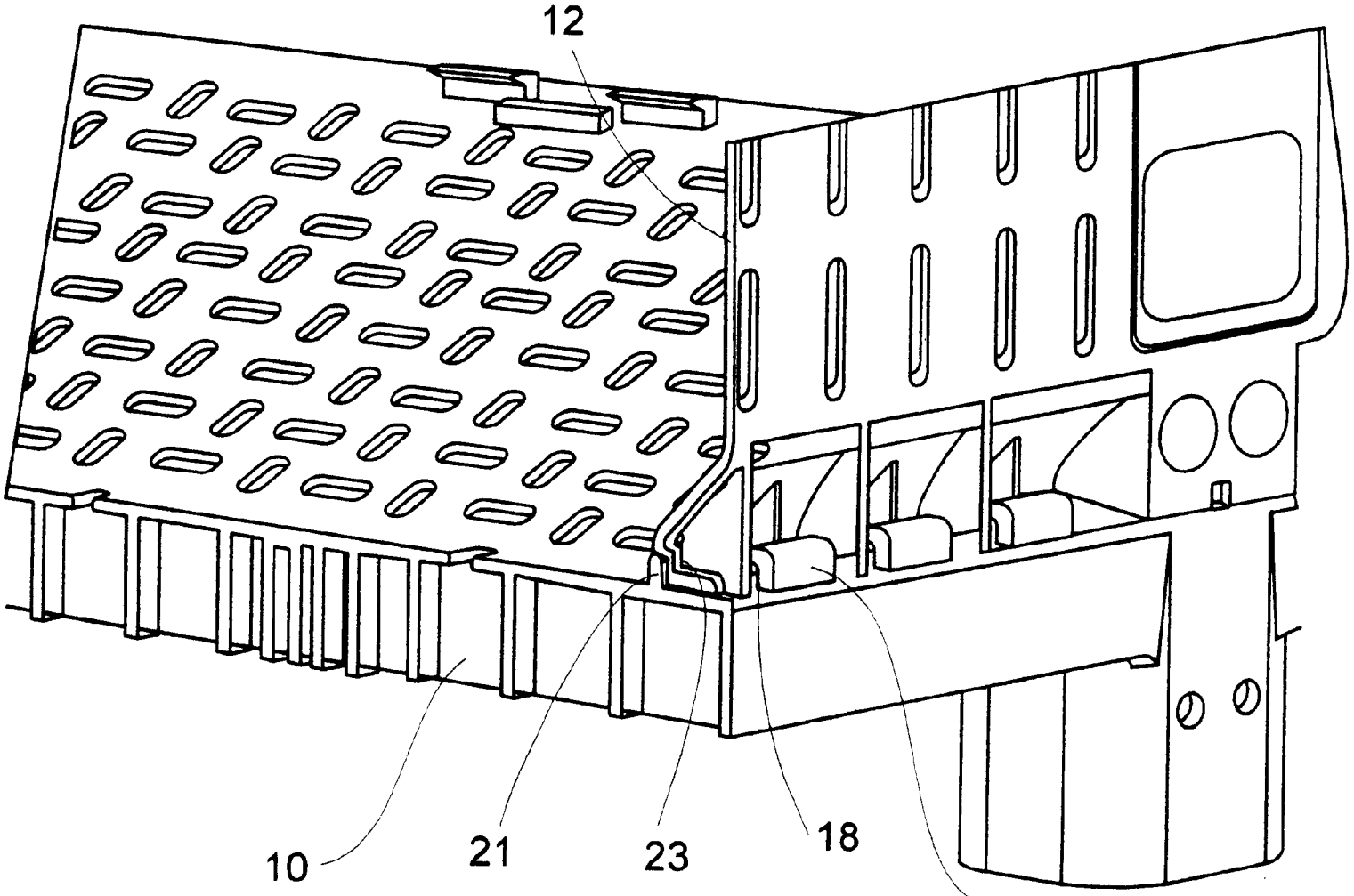
FIG. 7E is a partially cut-away enlargement of a portion of FIG. 7B.
Figure 8A:
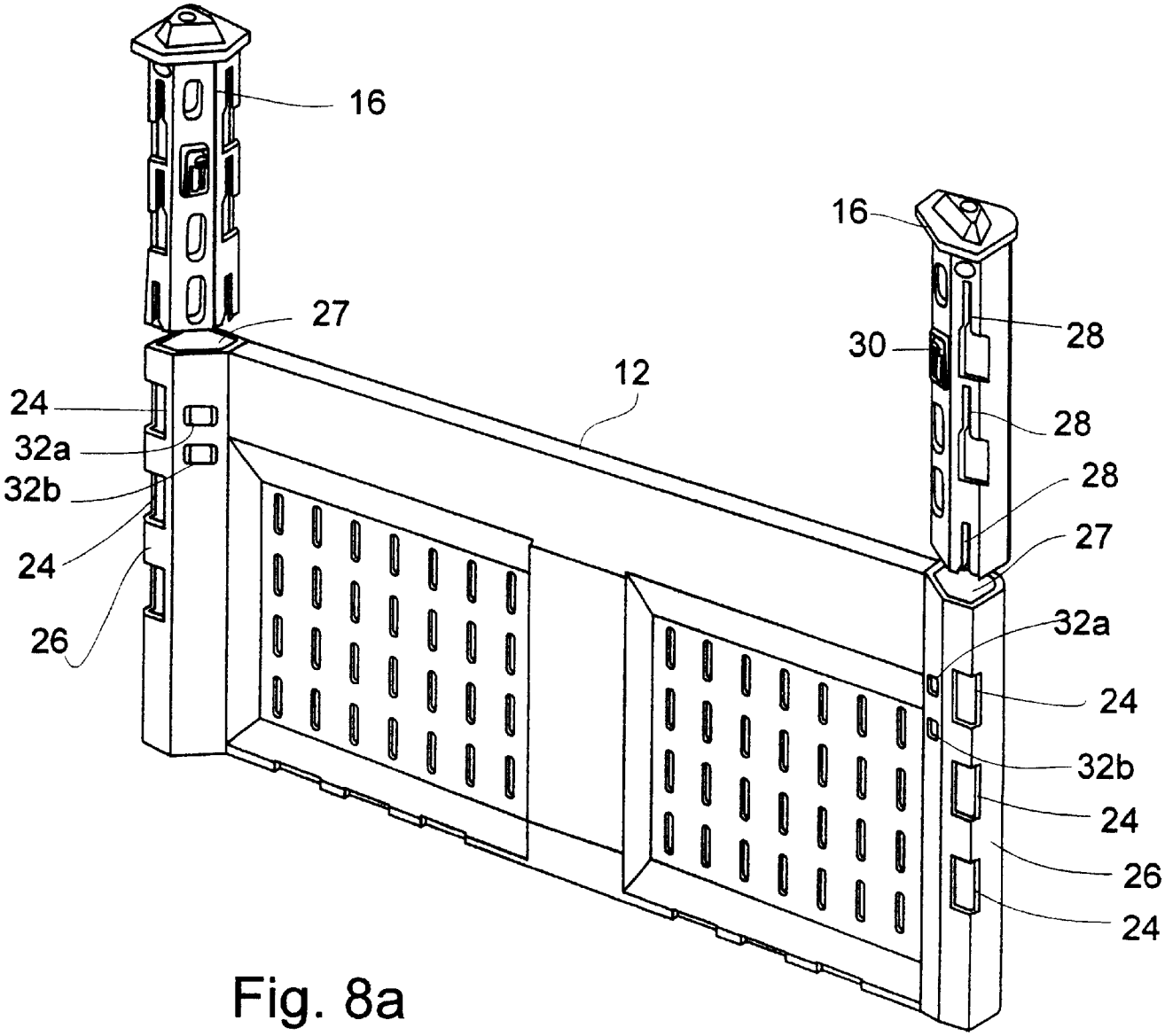
FIGS. 8A and 8B are perspective views showing the locking element of FIG. 6 before and after insertion to an unlocked position within a vertical channel in a corner post of the second side of FIG. 4.
Figure 8B:
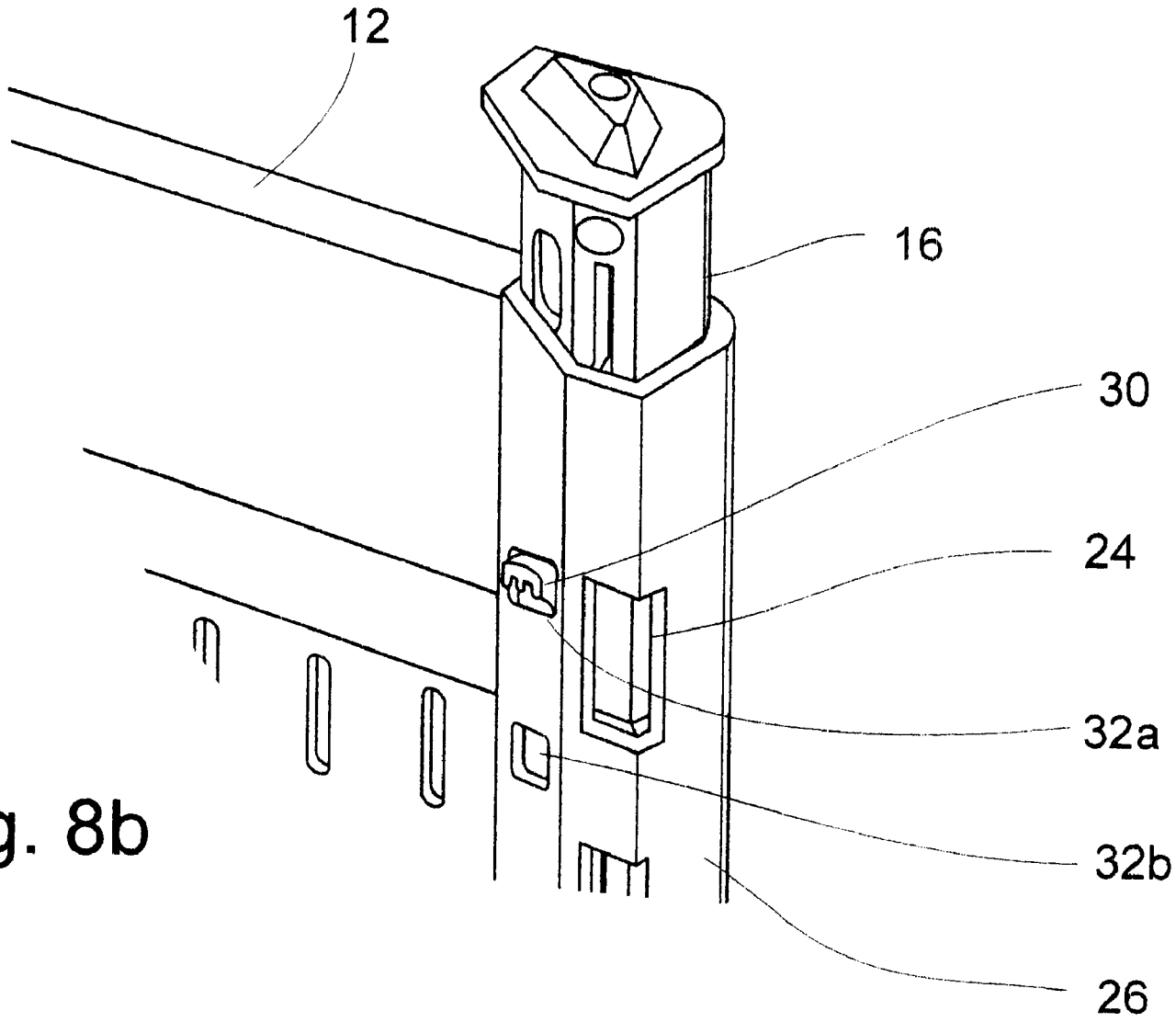
Figure 9A:
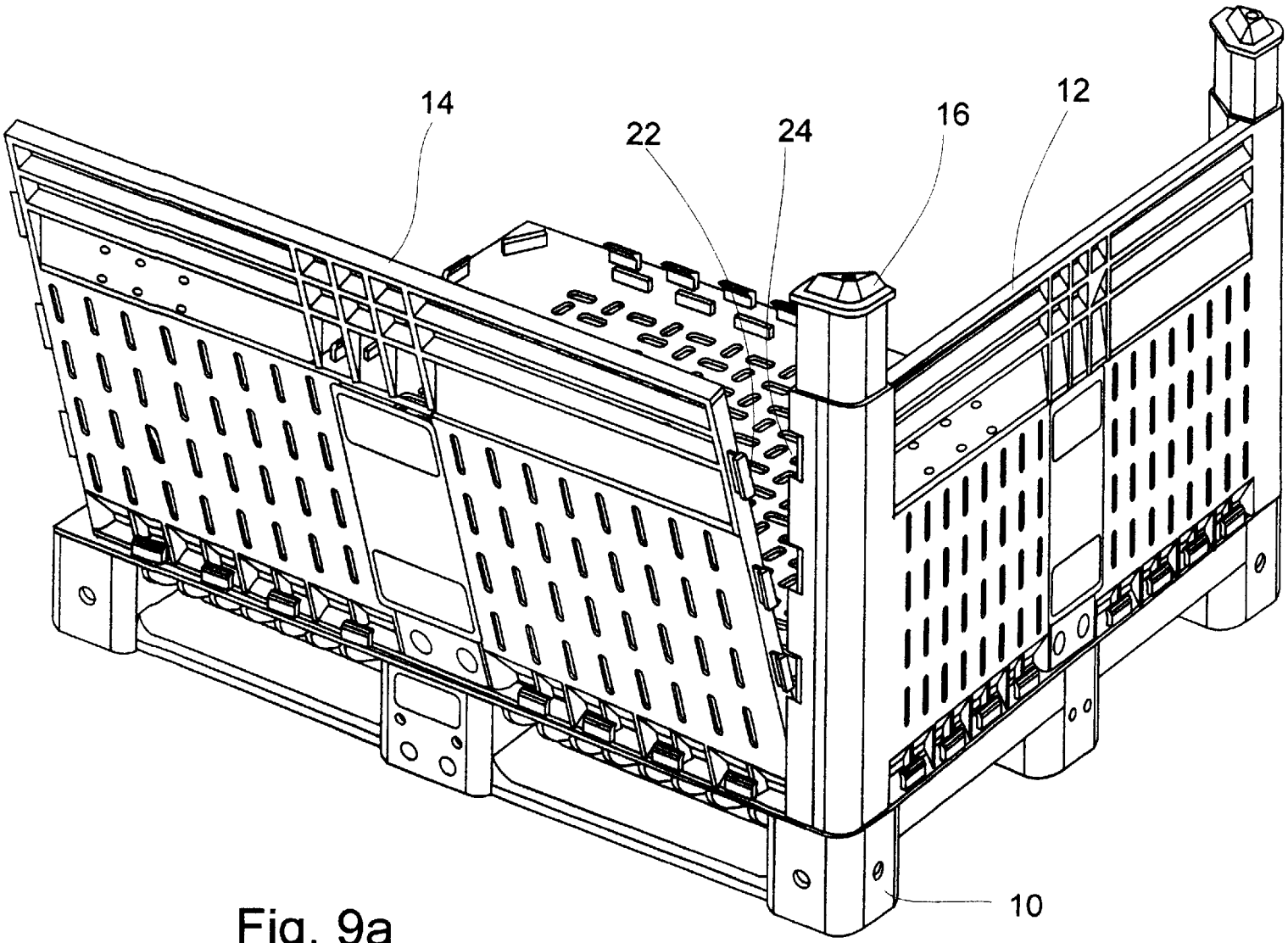
FIGS. 9A–9C are a series of perspective views showing the positioning of adjacent sides and sliding of the locking element from an unlocked position to a locked position in which is locks together the first and second sides of the bin.
Figure 9B:
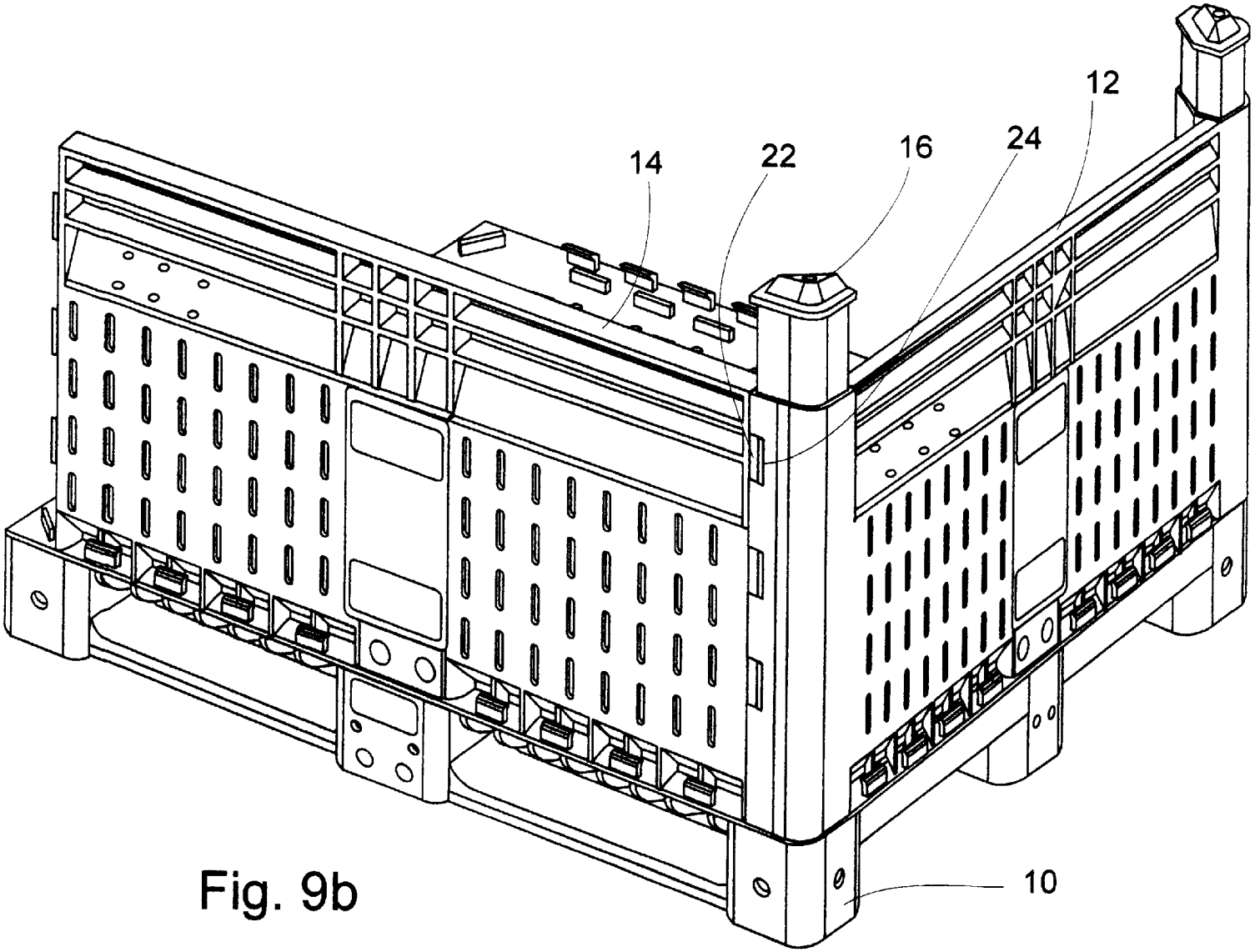
Figure 9C:
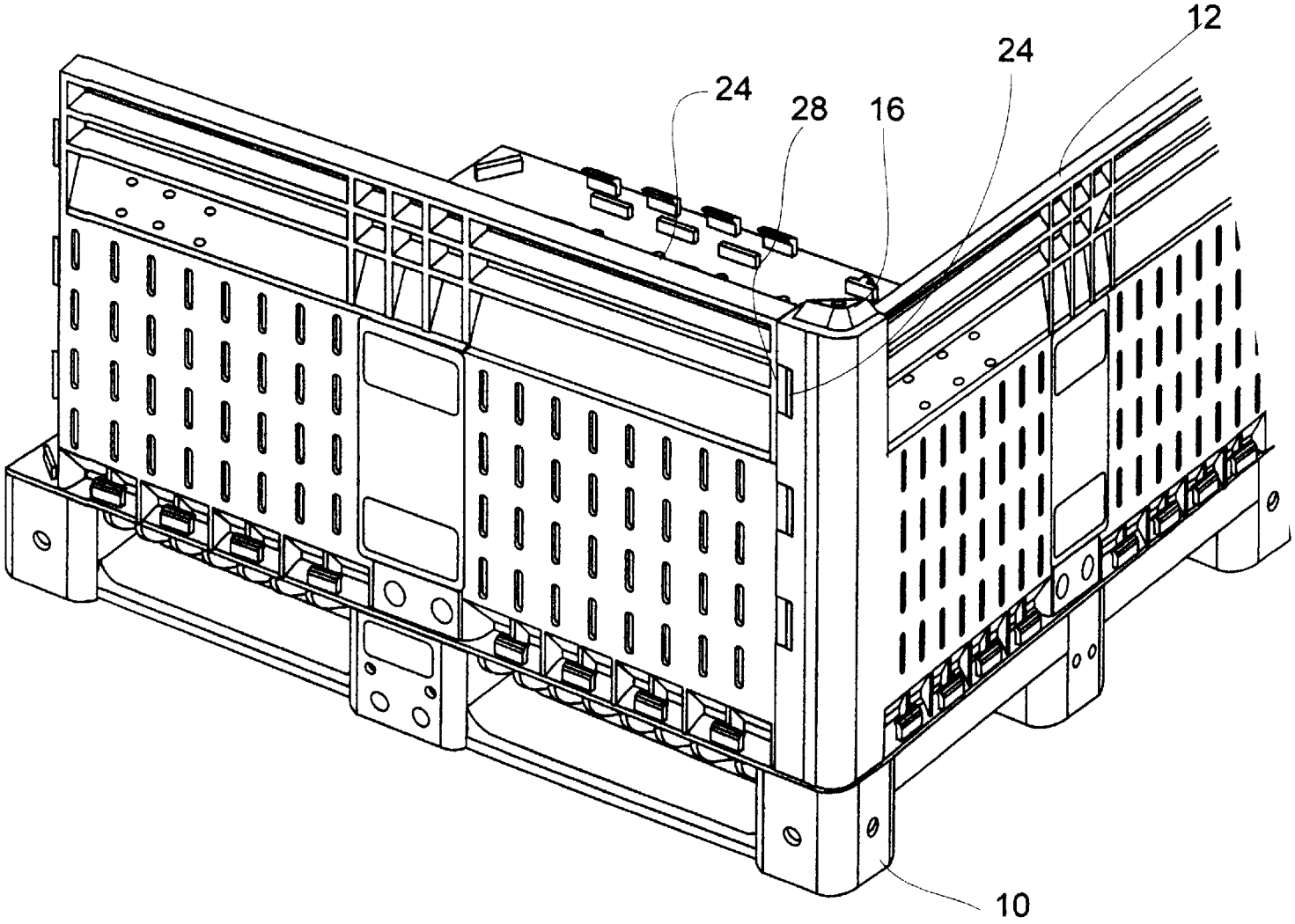
Figure 10:
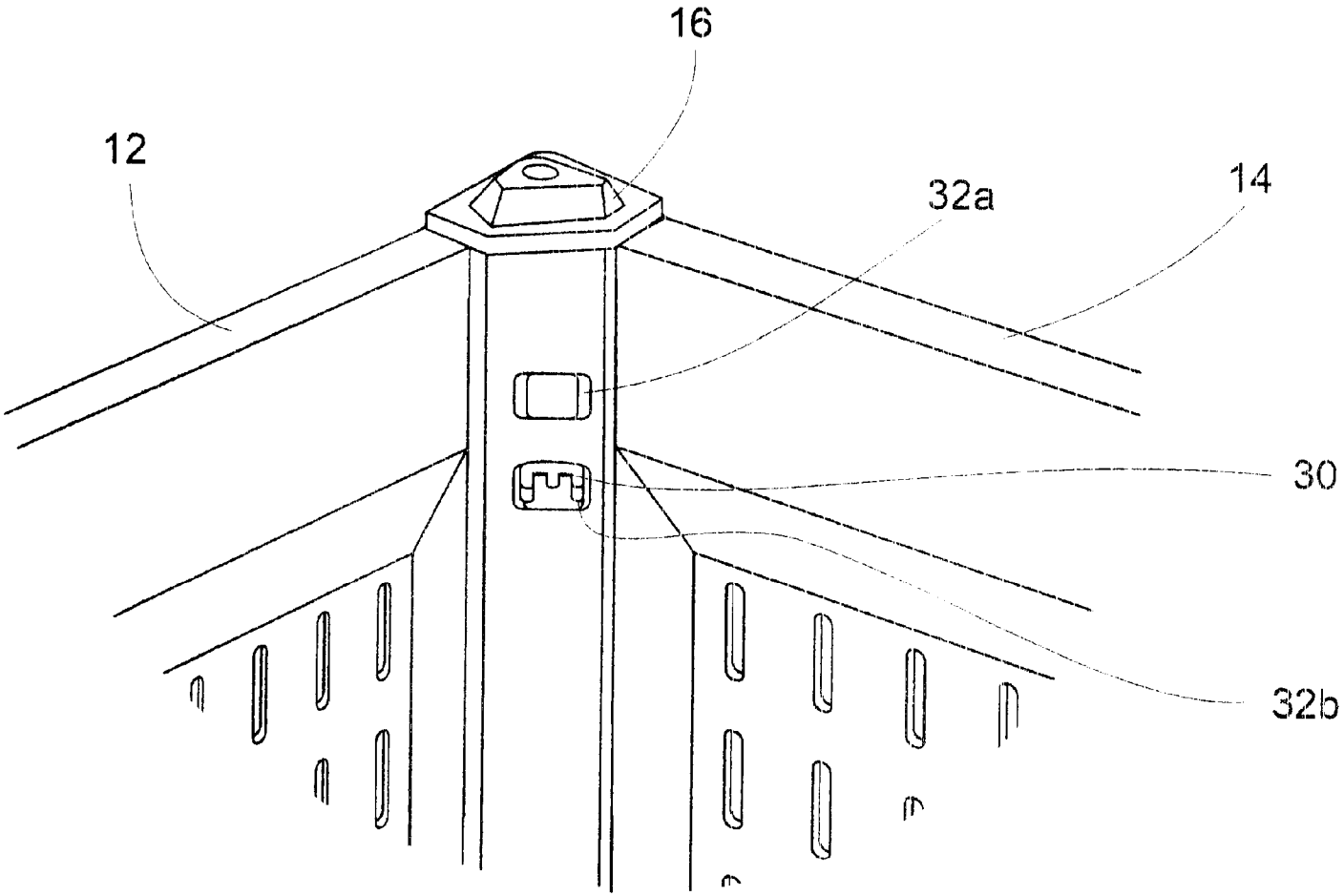
FIG. 10 is an internal perspective view of the assembled bin showing the locking element in its locked position.
Figure 11:
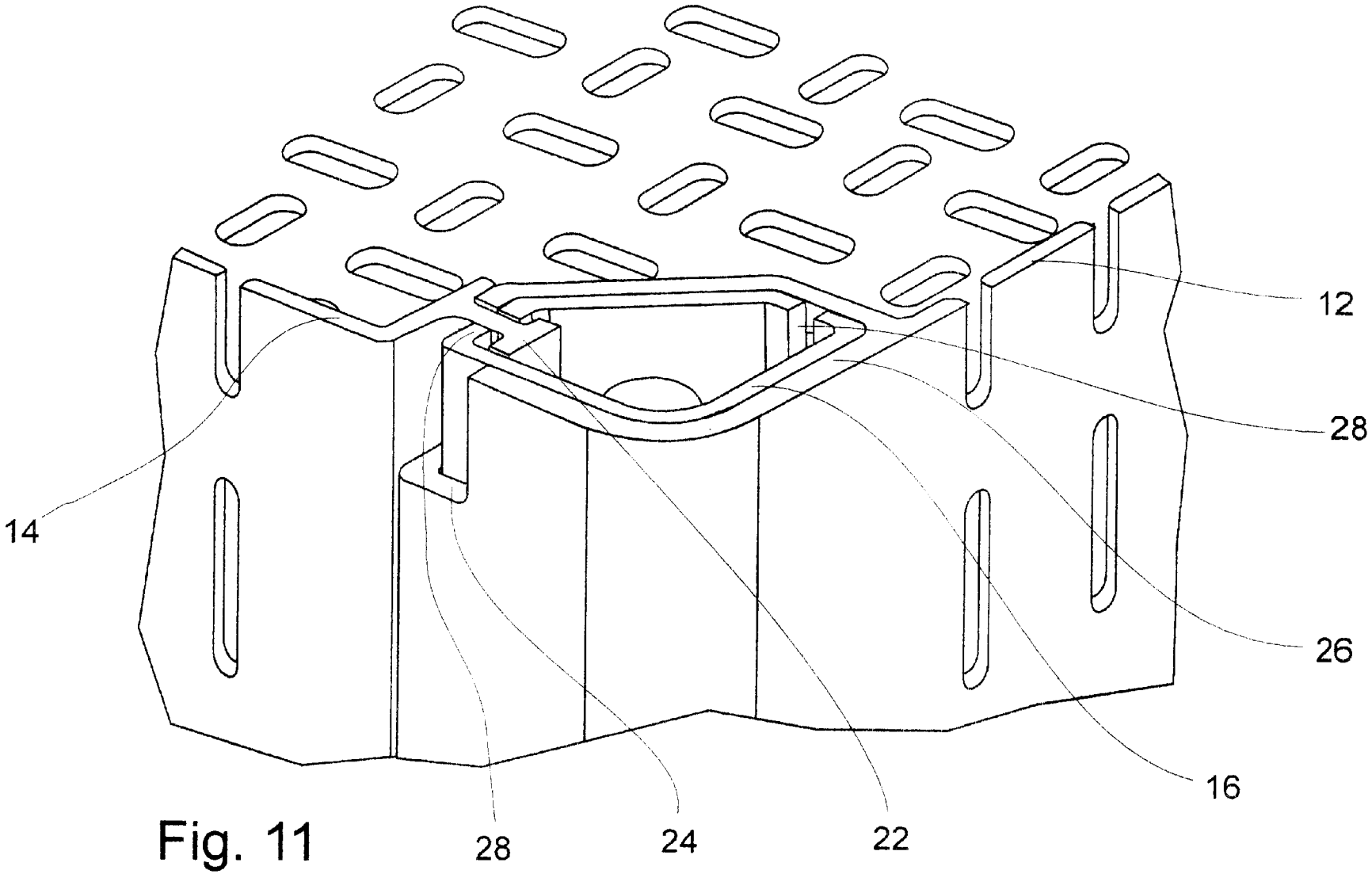
FIG. 11 is an enlarged, partially cut-away, perspective view showing the engagement of the locking element to connect together the first and second sides.

Attachment of the sides is then achieved by positioning each side in an outwardly-sloping position, as shown in FIGS. 7A and 7C, with engagement surfaces 18 aligned with brackets 20 and erecting the side to the position shown in FIGS. 7B, 7D and 7E so that engagement surfaces 18 become locked under brackets 20. Abutment ridges 21 abut the inner face of the side, preferably engaging corresponding rear sockets 23 (see FIG. 5), thereby preventing the side from slipping away from brackets 20 and limiting longitudinal movement of the sides along the line of contact with base 10. Preferably, one or more alignment feature, in this case an alignment projection 34 (see FIG. 2), is provided on base 10. The alignment feature is configured to engage with a corresponding alignment feature, in this case alignment recess 36 (see FIGS. 3 and 4), to help center and otherwise align the sides during positioning in the inclined position of FIG. 7A.

When any two adjacent sides are erected, the projections 22 of one side are located within the lateral openings 24 of the adjacent side. Preferably, projections 22 and openings 24 are configured such that the adjacent sides may be erected in any arbitrary order, thereby rendering the assembly process particularly easy and convenient.

It will be appreciated that the form of engagement described provides effective and rigid locking against movement of the sides relative to the base in all directions except for outward rotation back to the position of FIG. 7A. This motion is then prevented by the locking together of the sides, thereby rendering the bin a strong and rigid unitary structure.

Figure 13A:
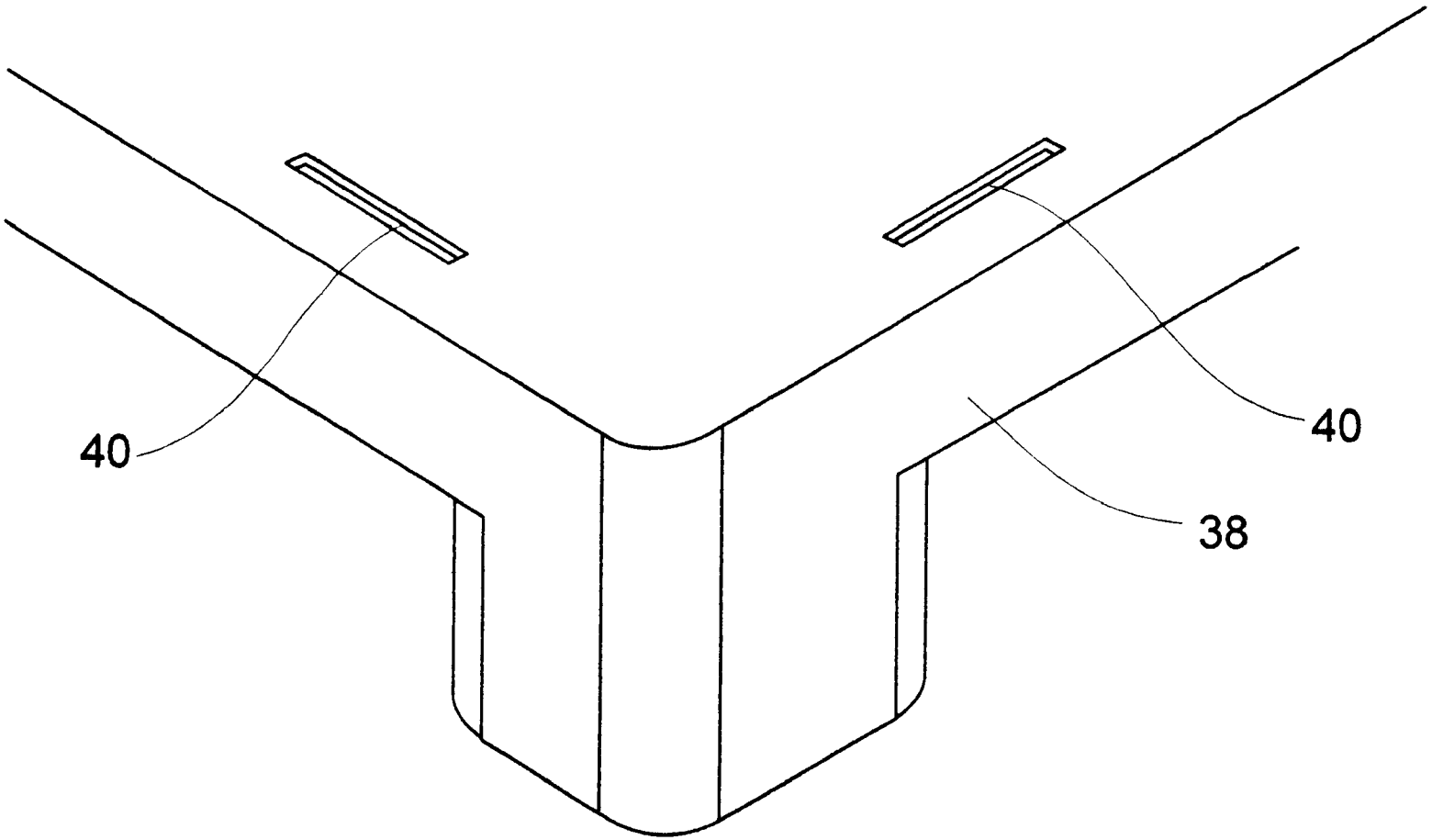
FIGS. 13A and 13B are schematic perspective views of part of a base and a side from a second variant of the bin of FIG. 1.
Figure 13B:
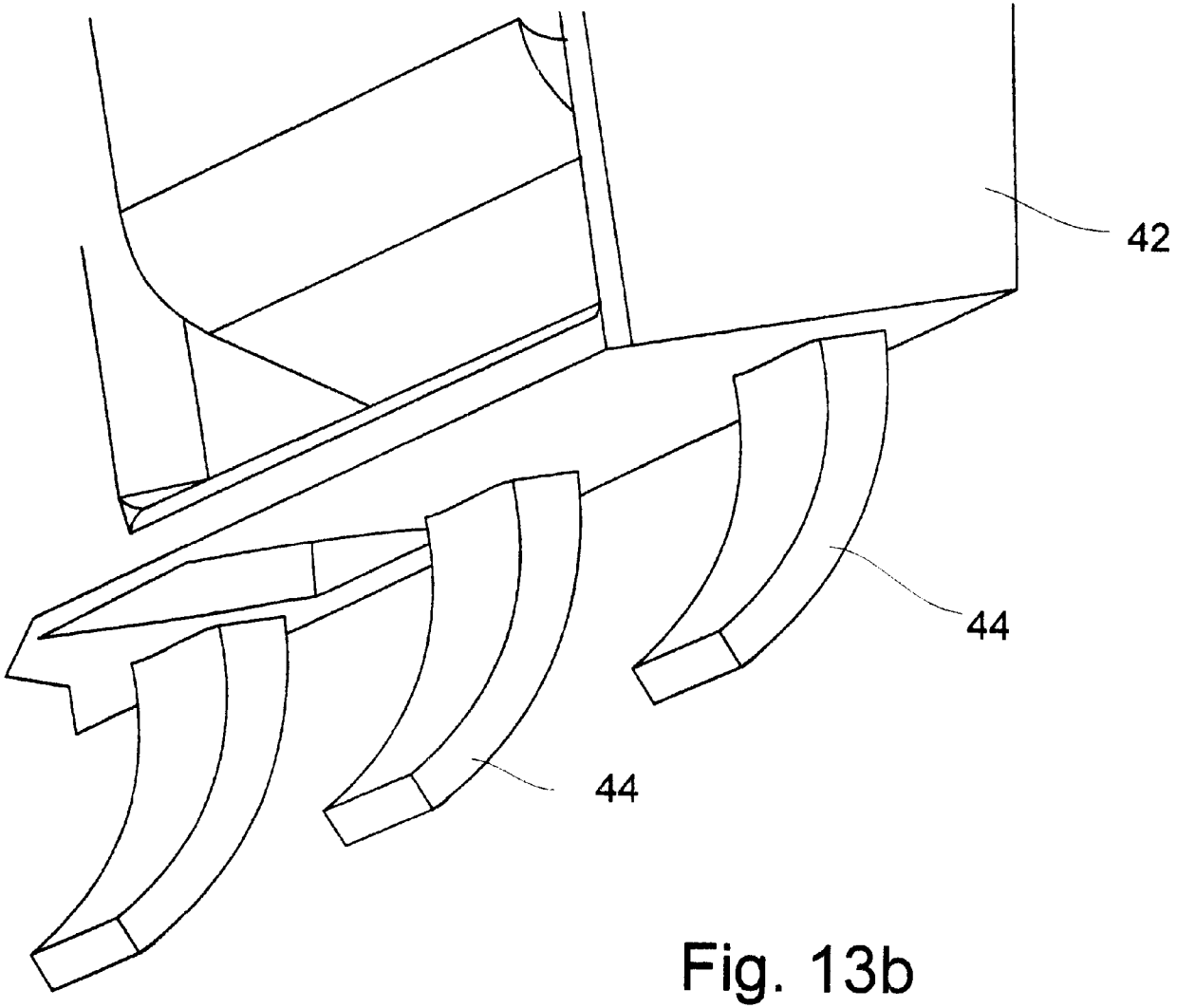

It should be noted that the configuration described thus far for engagement of the sides with the base is one example of a preferred implementation but may be substituted by other structures. Thus, referring parenthetically to FIGS. 13A and 13B, it should be noted that a similar effect may be achieved using a base 38 with slots 40 and sides 42 with arcuate projecting teeth 44. Here too, engagement is achieved while the side is inclined relative to the base, the elements becoming locked together when the sides are brought into an upright position.

Furthermore, although the invention is described herein primarily with reference to a preferred embodiment in which all four sides are detachable to achieve the knocked-down state, the locking configuration of the present invention may also be used to advantage with a range of other implementations. By way of example, other possible implementations include, but are not limited to: foldable containers in which one or more side is hingedly connected to the base; and fixed-walled containers with one or more wall, or part of a wall, which is removable or foldable for loading and unloading or for display. In each case, the locking configuration of the present invention may be employed to secure together all of the corner portions between adjacent sides of which at least one (or part thereof) moves. Alternatively, the locking configuration of the invention may be used to advantage in combination with conventional locking arrangements. An example of such an implementation would be a knock-down container in which the sides interlock when assembled in a specific sequence, the locking configuration of the present invention being used only to secure the last corner of the structure.

Figure 6:
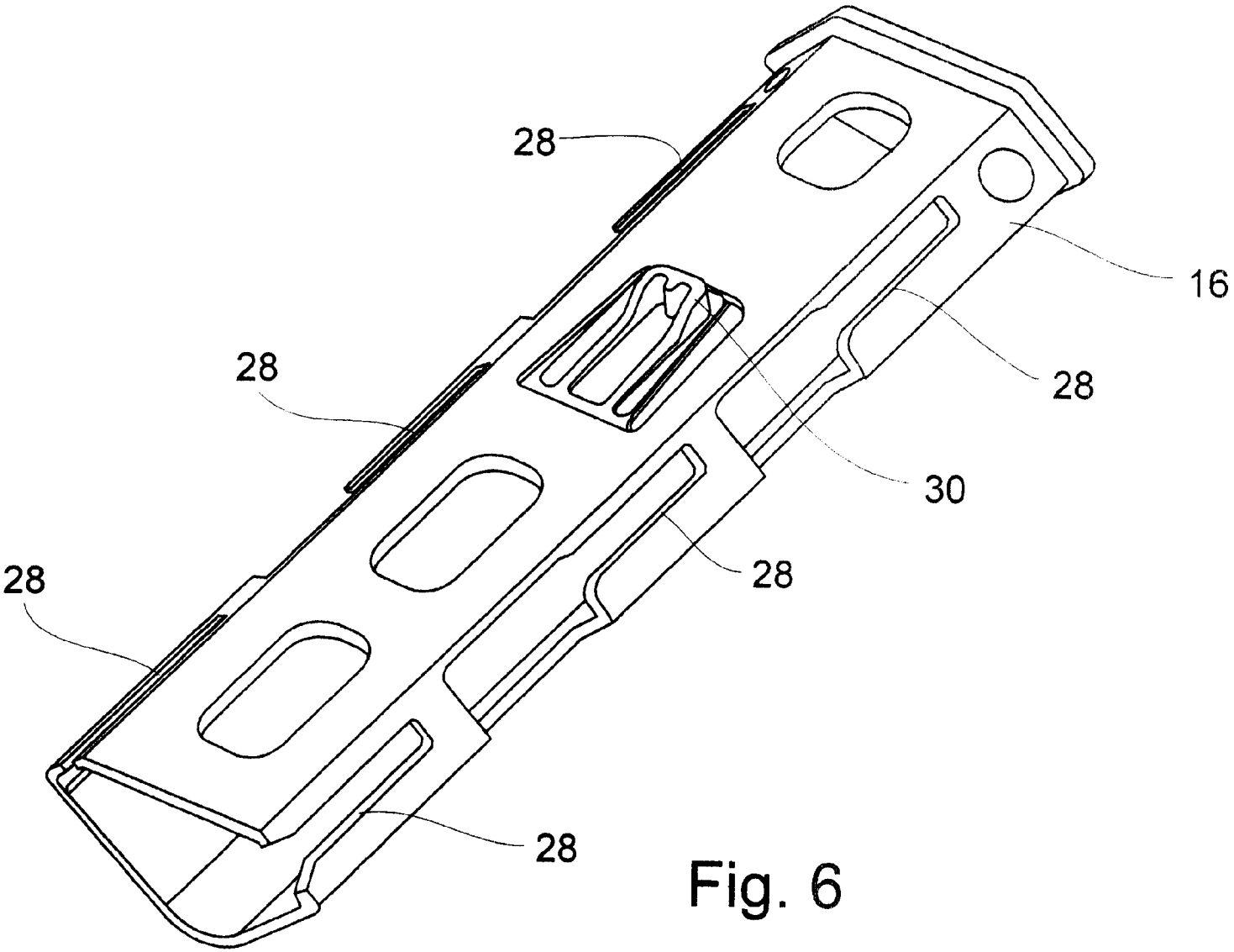
FIG. 6 is a perspective view of a locking element from the bin of FIG. 1.

Turning now to locking element 16, a preferred implementation of this is shown in FIG. 6. Locking element 16 features a number of slots 28 corresponding to the number of lateral openings 24 in vertical post 26. For large bins, this number is preferably at least three. For lightweight applications or for smaller bins (such as for domestic storage and the like), one or two points of engagement may be used.

In the preferred implementation illustrated here, locking elements 16 are double-sided, i.e., with two sets of slots 28. This allows the use of identical locking elements 16 for each corner without the need to distinguish between right-side and left-side attachment. In the structure shown, only one set of slots 28 is operative at any time, as may be observed from the cross-sectional view of FIG. 11.

As mentioned earlier, it is a particular advantage of certain preferred implementation of the present invention that locking element 16 remains housed within vertical channel 27 when in its unlocked position, thereby reducing the number of separate elements to be handled. Additionally, it is preferable that locking element 16 be retained in its unlocked position during attachment of sides 12 and 14 to avoid the need for complicated maneuvering and coordination to open element 16 while raising the sides. In the preferred implementation illustrated, this is achieved by providing locking element 16 with a resilient tab 30 configured to engage a corresponding first locating aperture 32*a* in corner post 26. First locating aperture 32*a* is positioned such that, when locking element 16 is in its unlocked position, resilient tab 30 engages first locating aperture 32*a* so as to retain locking element 16 in its unlocked position (see FIG. 8B). Clearly, a reversed implementation, having a tab associated with post 26 engaging a recess in locking element 16, would be functionally equivalent.

It is a further preferred feature of the present invention that the assembled bin remains securely and rigidly locked under a wide range of conditions of use, or even misuse. To this end, a second locating aperture 32*b* is preferably positioned such that, when locking element 16 is in its locked position, resilient tab 30 engages second locating aperture 32*b* so as to retain locking element 16 in its locked position (see FIG. 10). Although first and second locating apertures 32*a* and 32*b* serve somewhat distinct functions as has been described, most preferred implementations of the bin of the present invention feature both, thereby ensuring that locking element 16 is always positively and securely retained in the desired position. Clearly, a reversed implementation, having one or two tabs associated with post 26 engaging one or two recesses in locking element 16, would be functionally equivalent.

Another feature of preferred implementations of the present invention is that the sides of the bin, when separated, fit within another similar assembled bin, thereby facilitating convenient and compact return transport of the bins when not in use. In the example of FIGS. 1–11 where length L is greater than width W, this is achieved by forming all of the corner posts 26 as part of sides 12 which run parallel to the width. As a result, the length of sides 12 is equal to the external width W. The length of sides 14 is then less than external length L by twice the difference between the corresponding dimension of corner posts 26 and the length of projections 22. So long as this maximum length is chosen to be less than the length L by at least twice a thickness T of second sides 12, both types of sides can be accommodated parallel to the length within another similar bin. This allows compact and convenient return transportation of the empty bins with only the bases 10 piled separately, typically achieving a ratio of full-volume to empty-volume of at least about 3:1. It will also be noted that, unlike folding containers, this storage configuration is effective independent of the relative proportions between the height of the sides and the dimensions of the base.

Figure 12:
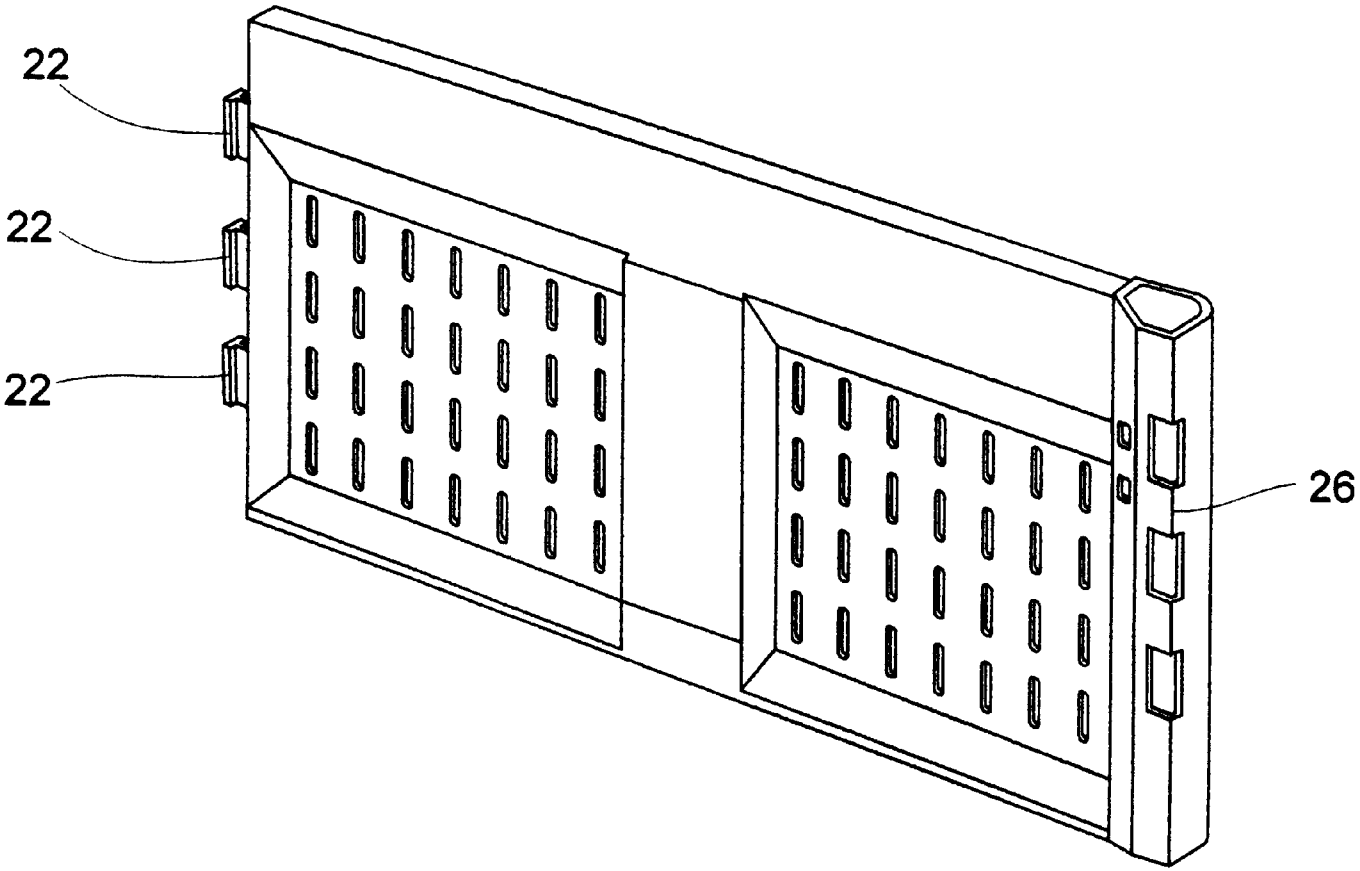
FIG. 12 is a perspective view of a side from a variant implementation of the bin of FIG. 1.

Turning now to FIG. 12, it should be noted that a similar packing efficiency can also be achieved for a square implementation (i.e., with W=L) of a bin according to the present invention. An example of a side for such a structure is shown in FIG. 12. In this case, all four sides are identical, each including one corner post 26. Since all of the interconnections are the same "handedness" (i.e., post 26 on the right and projections 22 on the left, or the reverse), locking element 16 can be simplified to a non-symmetric form (not shown) with only one set of slots 28. In other respects, this implementation is fully analogous to that of FIGS. 1–11.

Figure 14:
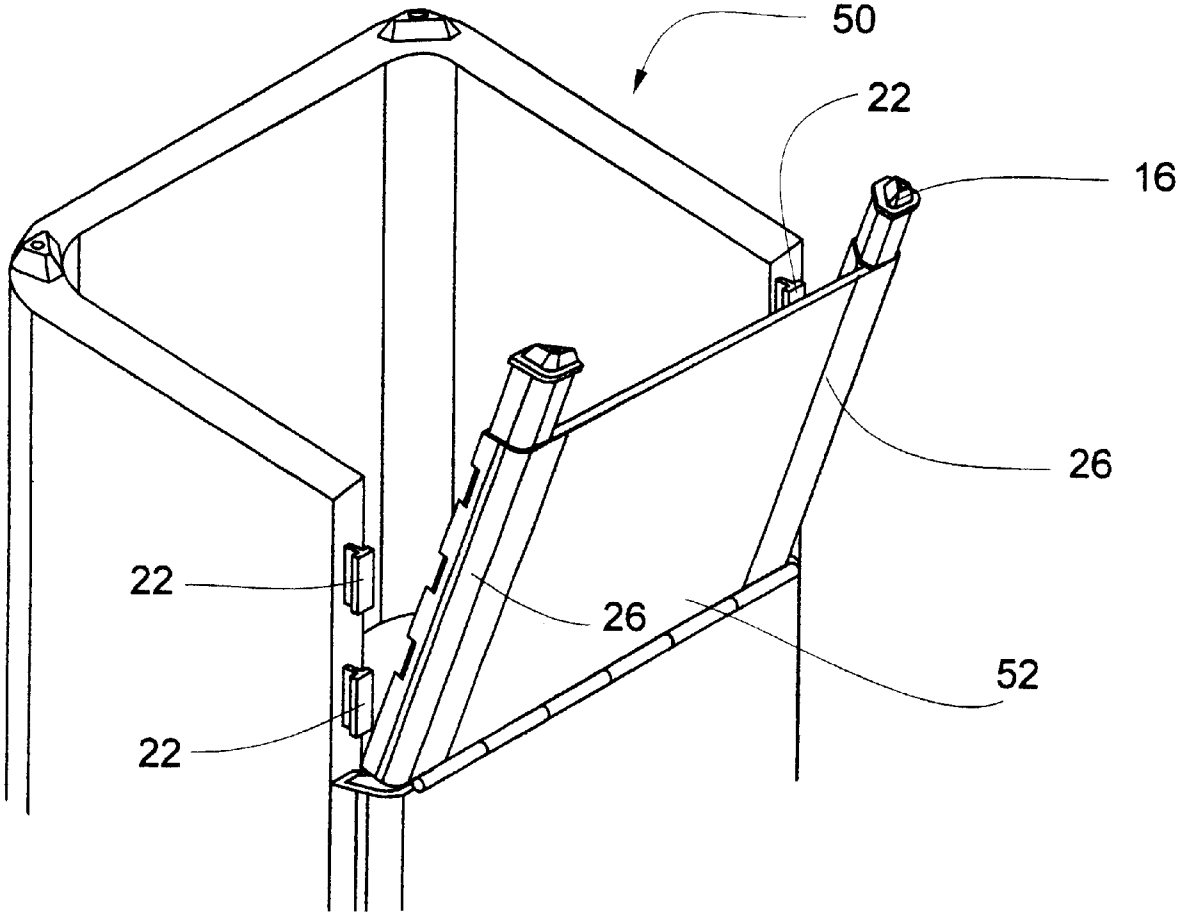
FIG. 14 is a schematic perspective view of a fixed-walled bin with a fold-down wall portion implemented using a locking configuration according to the teachings of the present invention.

Referring finally to FIG. 14, as mentioned before, the locking configuration of the present invention is applicable to a wide range of knock-down and fixed-wall bins in any situation that at least part of at least one wall is foldable or removable from other parts of the structure. By way of one schematic example, FIG. 14 shows a fixed-wall stackable bin 50 with a fold-down panel 52 for display purposes. In the example shown, panel 52 is hinged along its lower edge to a fixed lower part of a wall. The panel is releasably securable to the rest of the structure by use of two locking configurations which are fully analogous to the structures described in the preceding embodiments.

It will be appreciated that the above descriptions are intended only to serve as examples, and that many other embodiments are possible within the spirit and the scope of the present invention.

What is claimed is:

1. A knock-down bin comprising:

(a) a substantially rectangular base having a first dimension and a second dimension;

(b) a first two sides each having a lower edge detachably engagable with said base for deployment parallel to said first dimension;

(c) a second two sides each having a lower edge detachably engagable with said base for deployment parallel to said second dimension, such that said first two sides and said second two sides meet to define four vertical corner portions; and (d) at least one locking element deployable to lock together adjacent ones of said first two sides and said second two sides at at least one of said vertical corner portions, wherein said at least one of said corner portions includes a hollow vertical corner post integrally formed with one of said first and second sides, said corner post having a vertical hollow channel and a lateral opening into said channel, said at least one of said corner portions also having a projection integrally formed with another of said first and second sides, said projection being configured to project through said lateral opening into said vertical channel of said corner post, said locking element being configured so as to be slidingly deployable within said vertical channel of said corner post between an unlocked position in which said projection can be inserted and removed from said lateral opening and a locked position in which said locking element engages said projection so as to lock said projection within said channel, thereby locking together said adjacent ones of said first and second sides.

2. The bin of claim 1, wherein said at least one locking element is implemented as four of said locking elements deployable to lock together adjacent ones of said first two sides and said second two sides at all four of said corner portions.

3. The bin of claim 2, wherein said first dimension is greater than said second dimension, all of said corner posts being associated with said two second sides such that a maximum length both of said first sides and of said second sides is less than said first dimension by at least twice a thickness of said second sides.

4. The bin of claim 2, wherein said first dimension is equal to said second dimension, each of said first and second sides including one of said corner posts.

5. The bin of claim 1, wherein said base and at least one of said first and second sides are configured such that said side is engagable with, and disengagable from, said base while held in an inclined position relative to said base, said side becoming locked in engagement with said base when raised to an upright position.

6. The bin of claim 1, wherein said locking element includes a resilient tab, and wherein said corner post includes a first locating aperture positioned such that, when said locking element is in said unlocked position, said resilient tab engages said first locating aperture so as to retain said locking element in said unlocked position.

7. The bin of claim 1, wherein said locking element includes a resilient tab, and wherein said corner post includes a second locating aperture positioned such that, when said locking element is in said locked position, said resilient tab engages said second locating aperture so as to retain said locking element in said locked position.

8. The bin of claim 1, wherein said base, said first and second walls and said locking elements are all formed from polymer materials.

9. A locking configuration for releasably securing together edges of at least part of two adjacent sides at at least one corner portion of a substantially rectangular bin, the locking configuration comprising:

(a) a hollow vertical corner post integrally formed with a first of the adjacent sides, said corner post having a vertical hollow channel and a lateral opening into said channel;

(b) a projection integrally formed with another of said adjacent sides, said projection being configured to project through said lateral opening into said vertical channel of said corner post; and (c) a locking element configured so as to be slidingly deployable within said vertical channel of said corner post between an unlocked position in which said projection can be inserted and removed from said lateral opening and a locked position in which said locking element engages said projection so as to lock said projection within said channel, thereby locking together the adjacent sides.

10. The bin of claim 9, wherein said locking element includes a resilient tab, and wherein said corner post includes a first locating aperture positioned such that, when said locking element is in said unlocked position, said resilient tab engages said first locating aperture so as to retain said locking element in said unlocked position.

11. The bin of claim 9, wherein said locking element includes a resilient tab, and wherein said corner post includes a second locating aperture positioned such that, when said locking element is in said locked position, said resilient tab engages said second locating aperture so as to retain said locking element in said locked position.

* * * * *